US009781534B2

(12) United States Patent
Akino

(10) Patent No.: US 9,781,534 B2
(45) Date of Patent: Oct. 3, 2017

(54) CONDENSER MICROPHONE UNIT AND METHOD OF MANUFACTURING THE SAME

(71) Applicant: KABUSHIKI KAISHA AUDIO-TECHNICA, Machida-shie, Tokyo (JP)

(72) Inventor: Hiroshi Akino, Michida (JP)

(73) Assignee: KABUSHIKI KAISHA AUDIO-TECHNICA, Machida-Shi, Tokyo (JP)

( * ) Notice: Subject to any disclaimer, the term of this patent is extended or adjusted under 35 U.S.C. 154(b) by 0 days.

(21) Appl. No.: 14/851,953

(22) Filed: Sep. 11, 2015

(65) Prior Publication Data

US 2016/0094919 A1 Mar. 31, 2016

(30) Foreign Application Priority Data

Sep. 30, 2014 (JP) ..... 2014-200337

(51) Int. Cl.
*H04R 31/00* (2006.01)
*H04R 19/04* (2006.01)

(52) U.S. Cl.
CPC ..... *H04R 31/00* (2013.01); *H04R 19/04* (2013.01); *H04R 2201/003* (2013.01)

(58) Field of Classification Search
CPC ..... H04R 19/005; H04R 19/04; H04R 31/00
See application file for complete search history.

(56) References Cited

U.S. PATENT DOCUMENTS 3,418,546 A * 12/1968 Beavers ..... G01L 1/142 361/283.1
6,205,226 B1 * 3/2001 Senoo ..... H04R 17/00 310/311
2002/0071579 A1 * 6/2002 Himori ..... H04R 1/06 381/113
2006/0115106 A1 * 6/2006 Akino ..... H04R 19/04 381/369
2010/0189301 A1 * 7/2010 Akino ..... H04R 1/086 381/369

FOREIGN PATENT DOCUMENTS

JP 2000-50386 A 2/2000
JP 2008109212 * 8/2008
KR 20120132329 A * 12/2012

* cited by examiner

*Primary Examiner* — Md S Elahee
*Assistant Examiner* — Angelica M McKinney
(74) *Attorney, Agent, or Firm* — Manabu Kanesaka

(57) ABSTRACT

A condenser microphone unit includes a diaphragm vibrated by acoustic waves, a fixed electrode disposed to face the diaphragm, and an insulation base making contact with a rim portion of the fixed electrode to support the fixed electrode, wherein a ring-shaped protrusion is provided on a rim portion of the insulation base, the ring-shaped protrusion protruding toward the fixed electrode with a radially inward taper and having a ring-shaped distal face to oppose the rim portion of the fixed electrode, the distal face of the ring-shaped protrusion supports the rim portion of the fixed electrode, and an adhesive is provided on a tapered surface of the ring-shaped protrusion positioned between the insulation base and the fixed electrode, the adhesive having property to shrink by curing. When the adhesive is cured, contact portions of the insulation base and the fixed electrode are tightly bonded together.

2 Claims, 5 Drawing Sheets

CONDENSER MICROPHONE UNIT AND METHOD OF MANUFACTURING THE SAME

RELATED APPLICATIONS

The present application is based on, and claims priority from, Japanese Application No. JP2014-200337 filed Sep. 30, 2014, the disclosure of which is hereby incorporated by reference herein in its entirety.

BACKGROUND OF THE INVENTION

Field of the Invention

The present invention relates to a condenser microphone unit that can be used for, e.g., a narrow directional microphone equipped with an acoustic tube, and to a method of manufacturing the condenser microphone unit.

Description of the Related Art

FIG. 7 is a cross sectional view of a typical unidirectional condenser microphone unit. The condenser microphone unit illustrated in FIG. 7 includes a unit case 10 including a plurality of front acoustic terminal holes 10*a* on the front end surface thereof, an electroacoustic transducer 20 contained in the unit case 10, and a circuit board 30 disposed on the rear end opening of the unit case 10.

The electroacoustic transducer 20 includes a diaphragm 22 stretched across a supporting ring 21 with a predetermined tension, a disk shaped fixed electrode 24 supported on a face side of an insulation base 25, and a spacer ring 23 having electrical insulating property disposed between the diaphragm 22 and the fixed electrode 24.

As illustrated in the drawing, the diaphragm 22 and the fixed electrode 24 are disposed to oppose each other with the spacer ring 23 therebetween to form an electrostatic electroacoustic transducer 20.

A field-effect transistor (FET) 40 serving as an impedance converter is mounted on the circuit board 30.

The circuit board 30 includes a rear acoustic terminal 32. Acoustic holes (acoustic wave introducing holes) 25*a* and 24*a* are drilled in the insulation base 25 and the fixed electrode 24, respectively.

This configuration allows acoustic waves traveling from the rear acoustic terminal 32 to have effect on the back side of the diaphragm 22 via the acoustic holes 25*a* and 24*a*.

A predetermined acoustic resistance material 26 is disposed in the air chamber 50 provided between the fixed electrode 24 and the acoustic hole 25*a*.

By connecting an acoustic tube (not shown) to the front face side of the microphone unit, the microphone unit can be used as a microphone having narrow directional property.

However, the condenser microphone equipped with an acoustic tube having narrow directional property has disadvantage that narrow directional property cannot be provided by using the acoustic tube at low frequency because of the dimensional relationship between the length of the acoustic tube and the wavelength of acoustic waves. So that, for low frequencies where the acoustic tube does not work, an acoustic tube is connected to a front acoustic terminal of a unidirectional unit to operate the microphone as a unidirectional microphone. A microphone having narrow directional property equipped with an acoustic tube is disclosed in JP 2000-050386 A.

In the narrow directional microphone as described above, the effective distance between acoustic terminals at low frequency band is long, so that the acoustic mass of the acoustic tube is connected to the front side of the diaphragm 22 of the unidirectional condenser microphone unit. Thus the directional property of the unit should be adjusted to have directional frequency response almost identical to omnidirectional property when measured in a free space.

The air chamber 50 in the rear side of the fixed electrode 24 drives omnidirectional elements to the diaphragm 22 and determines the equivalent mechanical mass of the diaphragm 22 and a resonance frequency of the stiffness of the air chamber 50. To achieve the design providing a resonance frequency at a high limit of a sound collection band, the air chamber 50 should be designed to have a small volume to increase its stiffness.

In addition, to obtain directional frequency response almost identical to omnidirectional property, the acoustic resistance of the rear acoustic terminal 32 should be increased to reduce the force that drives bidirectional elements to the rear side of the diaphragm 22 from the rear acoustic terminal 32. Since the air chamber 50 has high stiffness, the acoustic resistance of the rear acoustic terminal 32 is designed to be very high.

However, when leakage occurs between the rear side of the diaphragm 22 and the acoustic resistance of the rear acoustic terminal 32, the effective acoustic resistance during operation is reduced and a problem arises that the intended directional property cannot be achieved.

Specifically, as illustrated in FIG. 8, the problem is the leakage from the contact portion (contact portion at the rim portion) between the insulation base 25 and the fixed electrode 24.

The fixed electrode 24 is usually punched out from a metal plate having an electret material (FEP film) thermally bonded thereto, so that the fixed electrode 24 has a rough end surface with a sheared surface 61 and a sharp edge 62.

The insulation base 25 is usually manufactured by injection molding of polycarbonate (PC). For the insulation base 25, shrinking of material during cooling produces roughness on the surface which is to make contact with the fixed electrode 24. These rough surfaces produced during manufacturing disadvantageously create a leak passage 63 between parts.

Moreover, variation in dimensions of the leak passage 63 disadvantageously causes difference in directional frequency response at low range among manufactured microphones. In particular, for a condenser microphone equipped with a long acoustic tube having narrow directional property, the leakage causes disadvantageous effects and has become a serious problem.

SUMMARY OF THE INVENTION

The present invention is made in view of the aforementioned problem. For a condenser microphone unit in which an insulation base supports the rim portion of a fixed electrode disposed to face a diaphragm, an object of the present invention is to provide a condenser microphone with no leakage from contact portions of the insulation base and the fixed electrode and a method of manufacturing the condenser microphone.

To solve the aforementioned problem, a condenser microphone unit according to the present invention includes a diaphragm vibrated by acoustic waves, a fixed electrode disposed to face the diaphragm, and an insulation base making contact with a rim portion of the fixed electrode to support the fixed electrode, wherein a ring-shaped protrusion is provided on a rim portion of the insulation base, the ring-shaped protrusion protruding toward the fixed electrode with a radially inward taper and having a ring-shaped distal face to oppose the rim portion of the fixed electrode, the distal face of the ring-shaped protrusion supports the rim portion of the fixed electrode, and an adhesive is provided on a tapered surface of the ring-shaped protrusion positioned between the insulation base and the fixed electrode, the adhesive having property to shrink by curing.

Preferably, contact portions of the insulation base and the fixed electrode are tightly bonded together when the adhesive is cured.

Preferably, the insulation base has on the tapered surface of the ring-shaped protrusion a plurality of positioning projections which makes contact with an outer circumferential surface of the fixed electrode to position the fixed electrode on the insulation base.

In such a configuration, the insulation base and the fixed electrode can tightly be bonded together with no gap therebetween when the adhesive is cured.

Consequently, with no leak passage between the insulation base and the fixed electrode, a condenser microphone equipped with a long acoustic tube having narrow directional property can be manufactured without variation in property among products.

To solve the aforementioned problem, a method of manufacturing a condenser microphone unit according to the present invention is a method of manufacturing a condenser microphone unit including a diaphragm vibrated by acoustic waves, a fixed electrode disposed to face the diaphragm, and an insulation base making contact with a rim portion of the fixed electrode to support the fixed electrode, and the method includes a step of forming a ring-shaped protrusion on a rim portion of the insulation base, the ring-shaped protrusion protruding toward the fixed electrode with a radially inward taper and having a ring-shaped distal face to oppose the rim portion of the fixed electrode, a step of supporting the rim portion of the fixed electrode by the distal face of the ring-shaped protrusion, a step of providing an adhesive on a tapered surface of the ring-shaped protrusion positioned between the insulation base and the fixed electrode, the adhesive having property to shrink by curing, and a step of curing the adhesive.

Preferably, in the step of supporting a rim portion of the fixed electrode by the distal face of the ring-shaped protrusion, the fixed electrode is positioned on the insulation base by a plurality of positioning projections provided on the tapered surface of the ring-shaped protrusion when fixed electrode makes contact with the insulation base.

Preferably, in the step of providing an adhesive, having property to shrink by curing, on the tapered surface of the ring-shaped protrusion positioned between the insulation base and the fixed electrode, the adhesive is provided in an inner side of the positioning projection.

Preferably, in addition, the distal face of the ring-shaped protrusion and the contact surface of the fixed electrode are both flat.

In the condenser microphone unit manufactured by such a method, the insulation base and the fixed electrode can tightly be bonded together with no gap therebetween when the adhesive is cured.

Consequently, with no leak passage between the insulation base and the fixed electrode, a condenser microphone equipped with a long acoustic tube having narrow directional property can be manufactured without variation in property among products.

Thus, a condenser microphone with no leakage from contact portions of the insulation base and the fixed electrode and a method of manufacturing the condenser microphone can be provided for a condenser microphone unit in which the insulation base supports the rim portion of the fixed electrode disposed to face a diaphragm.

DESCRIPTION OF THE PREFERRED EMBODIMENTS

Figure 1:
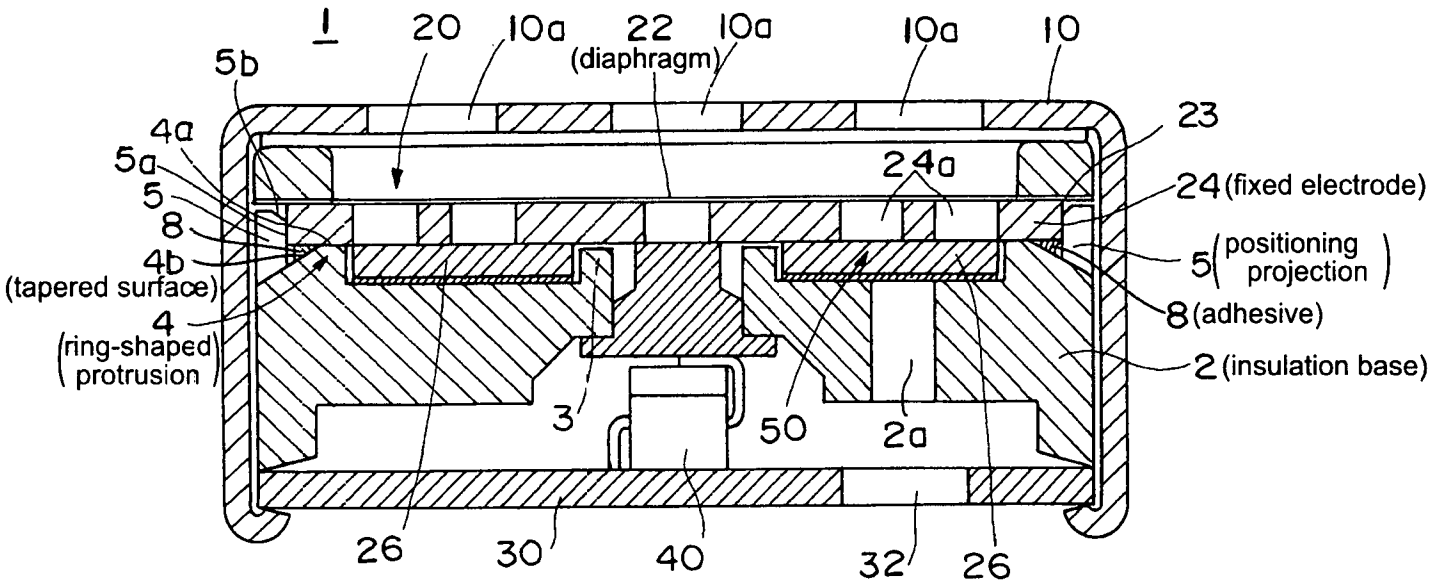
FIG. 1 is across sectional view of a condenser microphone unit according to an embodiment of the present invention.
Figure 7:
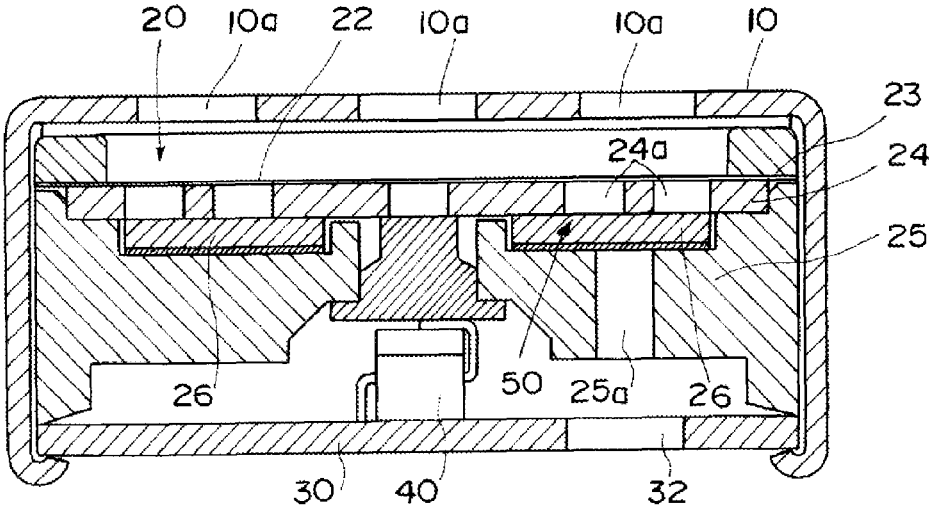
Fig. 7 Prior Art
FIG. 7 is a cross sectional view of a conventional condenser microphone unit.
Figure 8:
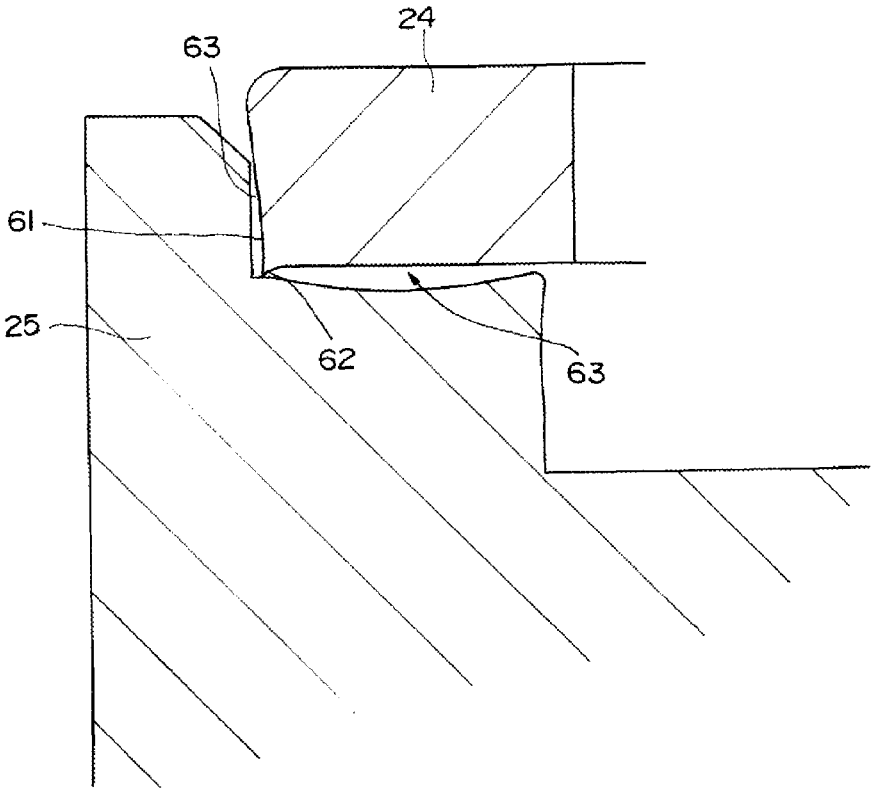
Fig. 8 Prior Art
FIG. 8 is a cross sectional view for explaining leakage from contact portions of the insulation base and the fixed electrode of a conventional condenser microphone unit.

An embodiment of the present invention will now be described referring to the drawings. FIG. 1 is a cross sectional view of a condenser microphone unit according to an embodiment of the present invention. For a condenser microphone unit 1 illustrated in FIG. 1, the component equivalent to that of the condenser microphone unit already described using FIG. 7 is appended with the same reference sign.

The illustrated condenser microphone unit 1 includes a unit case 10 including a plurality of front acoustic terminal holes 10*a* on the front end surface thereof, an electroacoustic transducer 20 contained in the unit case 10, and a circuit board 30 disposed on the rear end opening of the unit case 10.

The electroacoustic transducer 20 includes a diaphragm 22 stretched across a supporting ring 21 with a predetermined tension, a disk shaped fixed electrode 24 disposed to face the rear side of the diaphragm 22, and an insulation base 2 supporting the rim portion of the fixed electrode 24. A spacer ring 23 having electric insulating property is provided between the fixed electrode 24 and the diaphragm 22 at rim portions thereof with a predetermined gap therebetween. An electrostatic electroacoustic transducer 20 is thus configured.

A field-effect transistor (FET) 40 serving as an impedance converter is mounted on the circuit board 30. Agate electrode, one of three electrodes of the FET 40 is connected to the fixed electrode 24 via predetermined electrically connecting means.

To achieve unidirectional characteristics of the condenser microphone unit 1, a circuit board 30 includes a rear acoustic terminal 32, and acoustic holes (acoustic wave introducing holes) 2*a* and 24*a* are drilled in the insulation base 2 and the fixed electrode 24, respectively.

This configuration allows acoustic waves traveling from the rear acoustic terminal 32 to have effect on the back side of the diaphragm 22 via the acoustic holes 2*a* and 24*a*. A predetermined acoustic resistance material 26 is disposed in the air chamber 50 provided between the fixed electrode 24 and the acoustic hole 2*a*.

Figure 2:
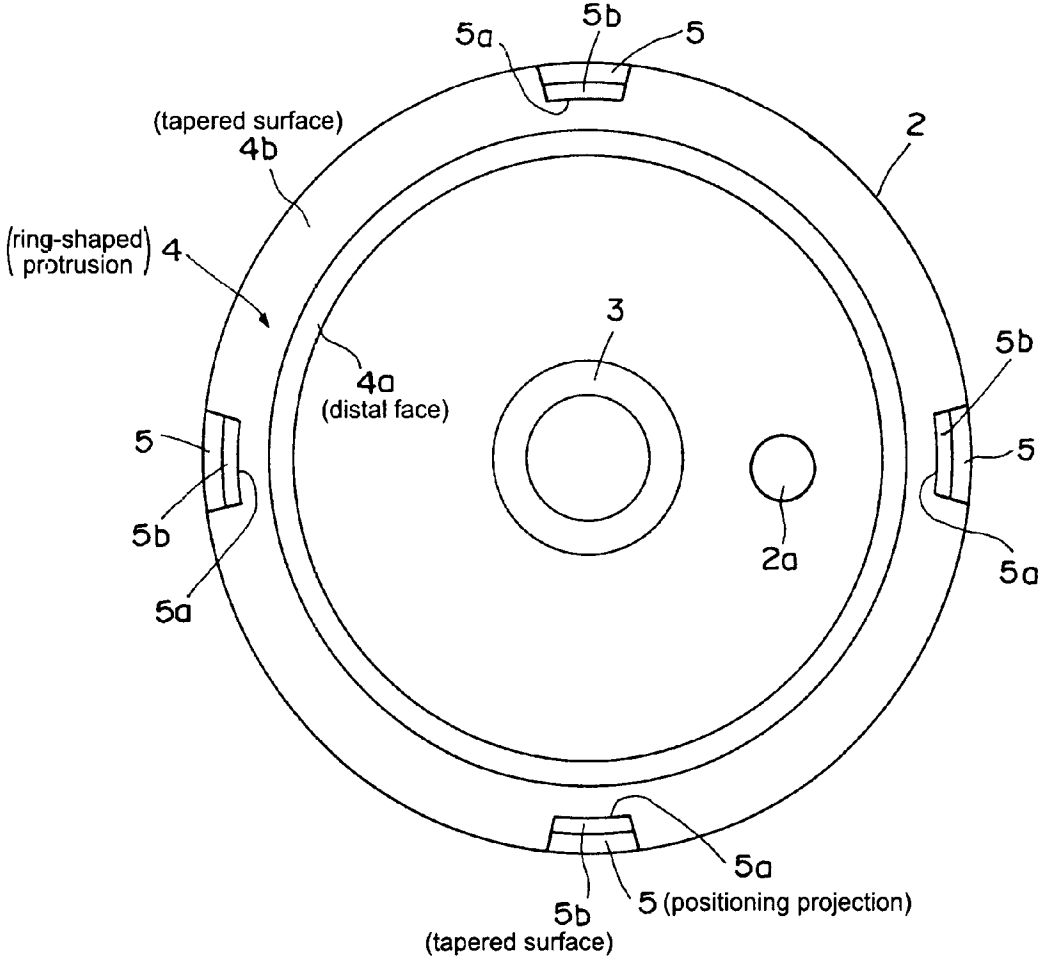
FIG. 2 is a plan view of an insulation base included in the condenser microphone unit illustrated in FIG. 1.

The condenser microphone unit 1 according to the embodiment is characterized by the configuration of the insulation base 2 supporting the fixed electrode 24. FIG. 2 is a plan view of the insulation base 2.

As illustrated in FIGS. 1 and 2, the insulation base 2 is provided with a small-diameter-ring-shaped protrusion 3 in the central portion and a large-diameter-ring-shaped protrusion 4 in the rim portion to support the rim portion of the fixed electrode 24.

The small-diameter-ring-shaped protrusion 3 protrudes to forma sleeve with a constant inner diameter and a constant outer diameter respectively. The outer circumferential surface of the small-diameter-ring-shaped protrusion 3 and the inner circumferential surface of the large-diameter-ring-shaped protrusion 4 forms an air chamber 50 in which the acoustic resistance material 26 is provided as illustrated in FIG. 1.

The large-diameter-ring-shaped protrusion 4 has an inner circumferential surface with a constant diameter. The outer circumferential surface of the large-diameter-ring-shaped protrusion 4 is a tapered surface 4*b* which is tapered radially inward and protrudes toward the fixed electrode 24. A distal face 4*a* continuing from the tapered surface 4*b* of the ring-shaped protrusion 4 is formed flat. The distal face 4*a* supports the bottom face of the rim portion of the fixed electrode 24.

Bar-like positioning projections 5 are provided at a plurality of circumferential positions (four positions in FIG. 2) on the tapered surface 4*b* of the large-diameter-ring-shaped protrusion 4. The positioning projections 5 extend upright to support the outer circumferential surface of the fixed electrode 24. The circumferential width of the positioning projection 5 is not particularly limited.

The height of the positioning projection 5 is such that the inner circumferential surface 5*a* of the positioning projection 5 makes contact with the bottom half section, approximately, of the outer circumferential surface of the fixed electrode 24 when the fixed electrode 24 is placed on the distal face 4*a* of the ring-shaped protrusion 4. The positioning projection 5 has a tapered surface 5*b* on the top front portion thereof so that the fixed electrode 24 can easily be placed on a predetermined position on the insulation base 2.

An adhesive 8 which shrinks by curing (e.g., rubber-based adhesive) is provided on the tapered surface 4*b* of the ring-shaped protrusion 4 in the space in the inner side of the positioning projection 5 and underneath the bottom face of the rim portion of the fixed electrode 24. When the adhesive 8 is cured, the fixed electrode 24 is supported on the insulation base 2 with no gap.

A step of placing the fixed electrode 24 on the insulation base 2 will now be described referring to FIGS. 3 to 6. FIGS. 3 to 6 are cross sectional views each partially illustrating the rim portion of the insulation base 2.

Figure 3:
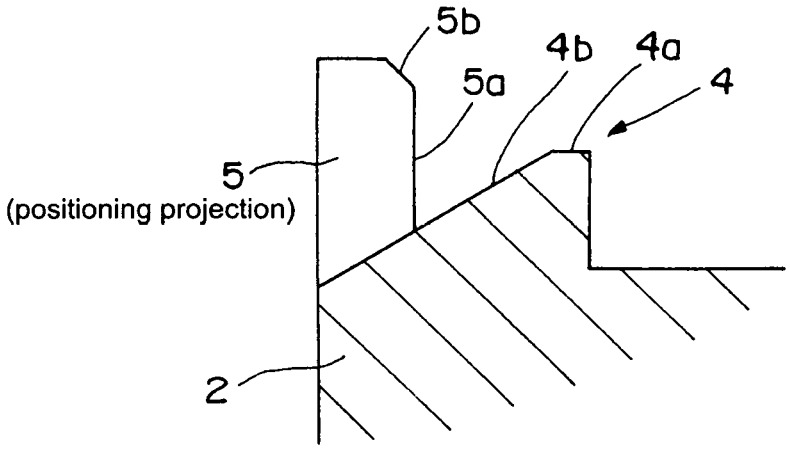
FIG. 3 is a partial cross sectional view illustrating a rim portion of an insulation base.
Figure 4:
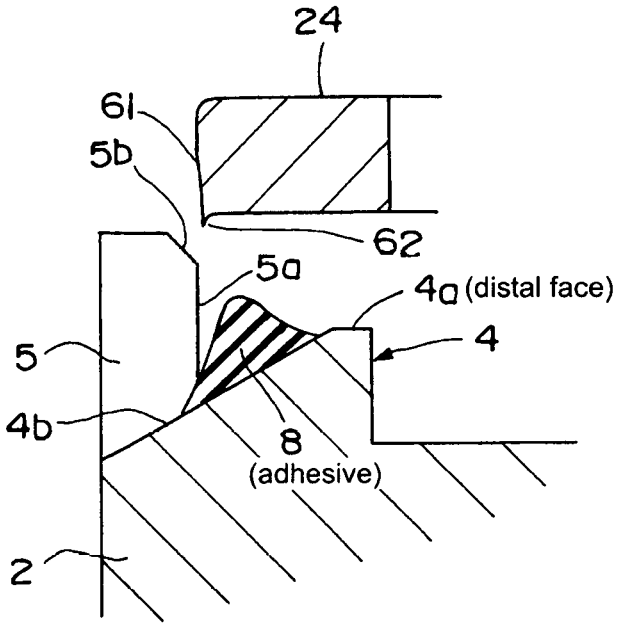
FIG. 4 is a partial cross sectional view illustrating the rim portion of the insulation base.

First, as illustrated in FIG. 4, an uncured adhesive 8 is provided in the inner side of the positioning projection 5 on the tapered surface 4*b* of the ring-shaped protrusion 4 of the insulation base 2 illustrated in FIG. 3.

Then the rim portion of the fixed electrode 24 is placed on the distal face 4*a* of the ring-shaped protrusion 4. Since the distal face 4*a* of the ring-shaped protrusion 4 and the contact surface of the fixed electrode 24 are both flat, a sheared surface 61 or a sharp edge 62 is allowed to exist on the end face of the fixed electrode 24 as illustrated in FIG. 4.

Figure 5:
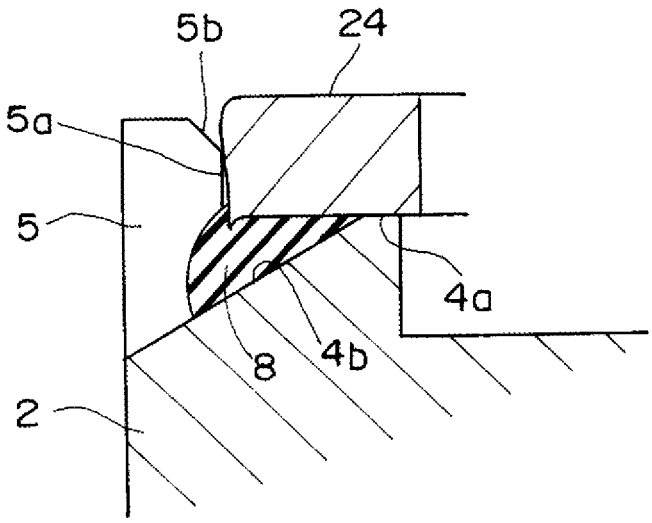
FIG. 5 is a partial cross sectional view illustrating the rim portion of the insulation base.

As illustrated in FIG. 5, the space which is in the inner side of the positioning projection 5 and surrounded by the bottom face of the rim portion of the fixed electrode 24 and the tapered surface 4*b* is filled with the adhesive 8.

Figure 6:
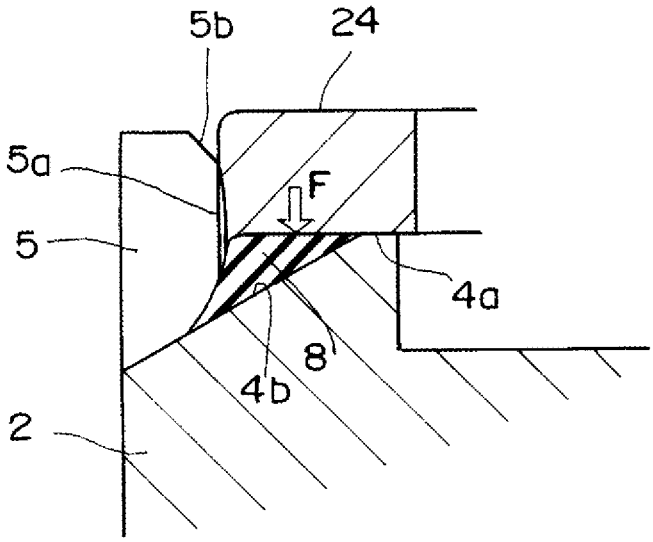
FIG. 6 is a partial cross sectional view illustrating the rim portion of the insulation base.

When thinner of the adhesive 8 volatilizes, the adhesive 8 shrinks, reducing its volume. As a result, as illustrated in FIG. 6, a force F is produced to pull the fixed electrode 24 toward the insulation base 2 to tightly bond together the bottom face of the rim portion of the fixed electrode 24 and the distal face 4*a* of the ring-shaped protrusion 4 of the insulation base 2. Since contact portions of the insulation base 2 and the fixed electrode 24 are flat, namely with no shrinkage recess on the insulation base 2 and no sharp edge produced by press forming on the fixed electrode 24, no gap exists between the contact portions, and therefore air leakage is prevented.

To prevent air leakage from between the insulation base 2 and the fixed electrode 24, the embodiment according to the present invention is configured that the insulation base 2 and the fixed electrode 24 are positioned to make contact with each other via flat contact portions and then tightly bonded together with no gap therebetween when the adhesive 8, which shrinks by curing, is cured.

Consequently, with no leak passage, a condenser microphone equipped with a long acoustic tube having narrow directional property can be manufactured without variation in property among products.

Although the embodiment is illustrated to have four positioning projections 5 on the rim portion of the insulation base 2, the number of positioning projections 5 is not limited. Note that, preferably at least three positioning projections 5 are circumferentially provided at an even pitch to make positioning of the fixed electrode 24 easy.

Although the embodiment is illustrated to provide the adhesive 8 before the insulation base 2 makes contact with the fixed electrode 24, other procedure can be used. The adhesive 8 may be provided after the insulation base 2 makes contact with the fixed electrode 24.

What is claimed is:

1. A condenser microphone unit comprising:

a diaphragm adapted to be vibrated by acoustic waves;

a fixed electrode including a contact surface at a bottom surface thereof and disposed to face the diaphragm;

an insulation base supporting the fixed electrode, and including a ring-shaped protrusion radially taperedly protruding toward the fixed electrode at a rim portion of the insulation base to support the fixed electrode, and a plurality of positioning projections arranged on the ring-shaped protrusion and contacting an outer circumferential surface of the fixed electrode to position the fixed electrode on the insulation base, the ring-shaped protrusion having a ring-shaped distal face contacting the contact surface of the fixed electrode, and a tapered surface radially downwardly tapered from the ring-shaped distal face toward an outer circumferential surface of the ring-shaped protrusion to form a space between the tapered surface and the contact surface; and an adhesive filled in the space between the tapered surface of the ring-shaped protrusion and the contact surface of the fixed electrode, wherein when the adhesive is cured, the fixed electrode and the insulation base are tightly bonded, and a thickness of the adhesive is radially thicker toward an outer portion of the adhesive, and the distal face of the ring-shaped protrusion and the contact surface of the fixed electrode are respectively flat such that no gap exists between the distal face and the contact surface to prevent air leakage.

2. The condenser microphone unit according to claim 1, wherein each of the plurality of positioning projections includes a tapered portion on a top portion thereof so that the fixed electrode is easily placed on the insulation base.

* * * * *